US005802782A

United States Patent [19]

Jewell

[11] Patent Number: 5,802,782

[45] Date of Patent: Sep. 8, 1998

[54] HEADER CONNECTION

[76] Inventor: Everett Jewell, P.O. Box 397, Dallas, N.C. 28034

[21] Appl. No.: 909,400

[22] Filed: Aug. 11, 1997

[51] Int. Cl.[6] ..... E04C 3/02; E06B 1/04

[52] U.S. Cl. ..... 52/204.2; 52/210; 52/643; 52/656.9

[58] Field of Search ..... 52/204.2, 210, 52/241, 474, 656.1, 656.9, 654.1, 643, 236.6; 403/337, 335, 363

[56] References Cited

U.S. PATENT DOCUMENTS

| | | | |
|---|---|---|---|
| 2,316,425 | 4/1943 | Hasenburger et al. | 52/210 X |
| 4,030,256 | 6/1977 | Ollman . | |
| 5,660,017 | 8/1997 | Houghton | 52/655.1 |
| 5,689,922 | 11/1997 | Daudet | 52/204.2 X |

OTHER PUBLICATIONS

Sheet of Drawings, Jewell Building Systems, Inc., Nov. 7, 1996.

*Primary Examiner*—Creighton Smith

*Attorney, Agent, or Firm*—Kennedy Covington Lobdell & Hickman

[57] ABSTRACT

An assembly for performing a header connection which includes a pair of vertically extending stud members each having a pre-determined depth and a side which includes two vertically extending edges, the stud members being oriented in space parallel relation with the sides opposed to each other. Each of the sides includes a pair of projecting generally parallel first flanges which are spaced apart from each other a distance less than the depth of the stud members, and which are positioned offset inwardly from the edges. A header member has two ends and a body portion which extends between the ends, and each of the ends has a pair of longitudinally projecting generally parallel space second flanges which are formed to engage the first flanges in lapping relation offset inwardly from the edges of the stud member sides. A fastening arrangement is provided for fastening the first flanges to the second flanges, whereby the header member can be mounted between the stud members and the first and second flanges are offset inwardly from the edges.

15 Claims, 6 Drawing Sheets

HEADER CONNECTION

BACKGROUND OF THE INVENTION

The present invention relates generally to the configuration of a header connection for the structural frame of a building, and more particularly to an assembly for forming a header connection which can be easily and efficiently assembled and which is aligned with the exterior and interior surfaces of the building frame in a desirable manner.

The construction of structural building frames through the use of pre-cut and prepared components, such as metal studs and trusses, has increased in popularity as the benefits of such building systems have been realized. While metal framing systems have long been used for commercial buildings, such systems are now commonly used for residential buildings, and provide significant advantages in quality, efficiency of use, environmental effects, and resistance to decay and pests.

Metal framing systems are typically recyclable, well over half of steel framing members, for example, are already produced from recycled steel. Pre-cutting and prefabrication of structural members also significantly reduces in-field waste, and metal framing members experience few problems with varying quality or dimensional inconsistency when compared with wood. Metal framing members are also termite-resistant, do not rot, and provide additional fire safety in that they are non-combustible. Prefabricated framing systems have, however, often required the addition of certain components which are not required in typical wood frame construction. This is in part due to the typical structure of the trusses used in such systems, which consist of two chord members and an open web portion formed by spaced struts.

In particular, where truss members are used as wall studs, the most desirable portion of the stud for attachment thereto of other components, such as structural headers which span window and door openings, will be the flat portions of the chords of the truss forming the stud, and these chords will be positioned with their flat portions in the planes of the exterior and interior surfaces of the building frames. Thus, any connections made into such chords by threaded fasteners or other typical arrangements result in screw heads, other fastener portions, or welds creating irregularities on such exterior and interior surfaces. Surface irregularities of this type interfere with the mounting of sheathing or cladding on the structural frame, which requires an expanse of attachment surfaces generally in the same plane in order for the sheathing or cladding to be mounted in an attractive and functional manner. The use of girts, furring or other arrangements is therefore typically required in order to create level surfaces on which the sheathing or cladding can be attached to prefabricated framing systems.

The efficiency of such building systems would be enhanced if the use of girts and furring could be eliminated by providing uniform exterior and interior surfaces at header connections, so that sheathing and cladding could be attached directly to the studs. By eliminating the girts or furring, material costs would be reduced, a step in the construction process would be eliminated, and the time required for completion of projects reduced.

The present invention provides an assembly for forming a header connection which eliminates the aforesaid limitations of conventional building systems which require the use of girts or furring, and which provides for easy and efficient connection of a header member to stud members, structural strength, and a uniform surface for attachment of sheathing or cladding thereto.

SUMMARY OF THE INVENTION

It is accordingly an object of the present invention to provide an assembly for forming a header connection in which a header member is fastened to stud members at locations which are removed from the exterior and interior edges of the stud members, and in which the header connection can be easily, efficiently, and rigidly made.

Briefly summarized, the present invention accomplishes this objective by providing an assembly which includes a pair of vertically extending stud members which each have a pre-determined depth and a side having two vertically extending edges. The stud members are oriented to each other in spaced parallel relation with the respective sides thereof in opposed relation. Each side of the stud members includes a pair of projecting generally parallel first flanges which are spaced apart from each other a distance less than the depth of the stud members, and the first flanges are also positioned offset inwardly from the edges of the stud member sides.

A header member is provided which has two ends and a body portion which extends between the ends, and each of the ends includes a pair of longitudinally projecting generally parallel spaced second flanges which are formed to engage the first flanges in lapping a relation. The assembly further includes an arrangement for fastening the first flanges to the second flanges, whereby the header member can be mounted between the stud members and the first and second flanges are offset inwardly from the edges of the stud member sides.

In a preferred embodiment, the header member includes a top surface and a pair of generally parallel spaced flanges projecting upwardly therefrom intermediate the ends of the header member, and further includes a cripple stud member which is received in the upwardly projecting flanges and extends upwardly therefrom in spaced parallel relation to the stud members, and a fastening arrangement fastens the cripple stud member to the upwardly projecting flanges.

The edges of the stud member sides may comprise an exterior edge and an interior edge, with the exterior edges being generally aligned with each other, and the interior edges being generally aligned with each other. The header member may include a generally planar exterior surface which is generally aligned with the exterior edges, and a generally planar interior surface generally aligned with the interior edges.

Each of the stud members may be a truss member including a pair of vertically extending space chord members in the form of channel members, and a web portion which may comprise a plurality of struts. The stud member sides may each include a plate member which is mounted on the chord members and which supports the first flanges.

The second flanges may be received within the first flanges in lapping relation, and each of the second flanges may include a distal portion which has an inwardly angled end so that it can be easily engaged within the first flanges. The first and second flanges may advantageously be formed from channel members.

The invention will be described in further detail below in terms of an exemplary embodiment of an assembly for forming a header connection.

DETAILED DESCRIPTION OF THE PREFERRED EMBODIMENT

Figure 1:
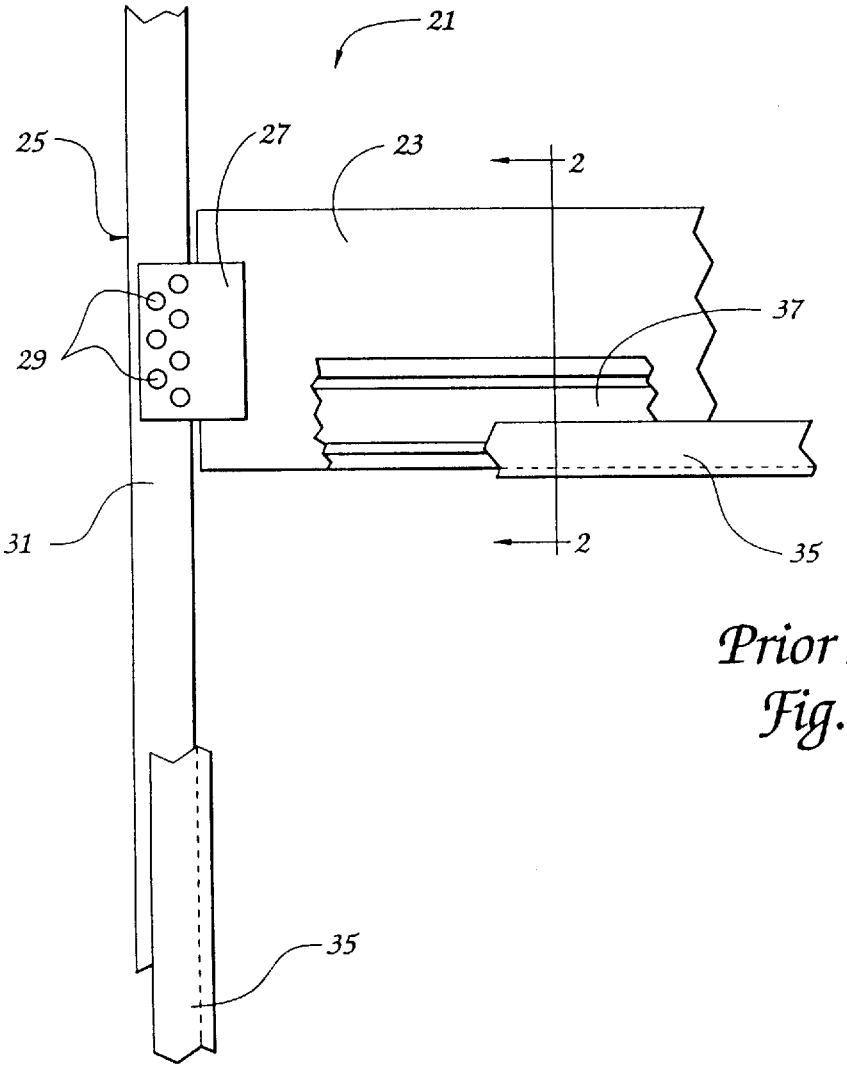
Prior Art Fig. 1
FIG. 1 is a front elevational view of a header to jamb connection.

Looking now in greater detail at the accompanying drawings, FIG. 1 illustrates a conventional header connection assembly, 21, in which a header member 23 is connected to a jamb member 25 by a joining tab 27 and threaded fasteners 29. The tab 27 is typically welded to the header 23 during prefabrication, and is then fastened by threaded fasteners 29 to an outer surface 31 and an interior surface 33 (see FIG. 2) of the jamb member 25.

Figure 2:
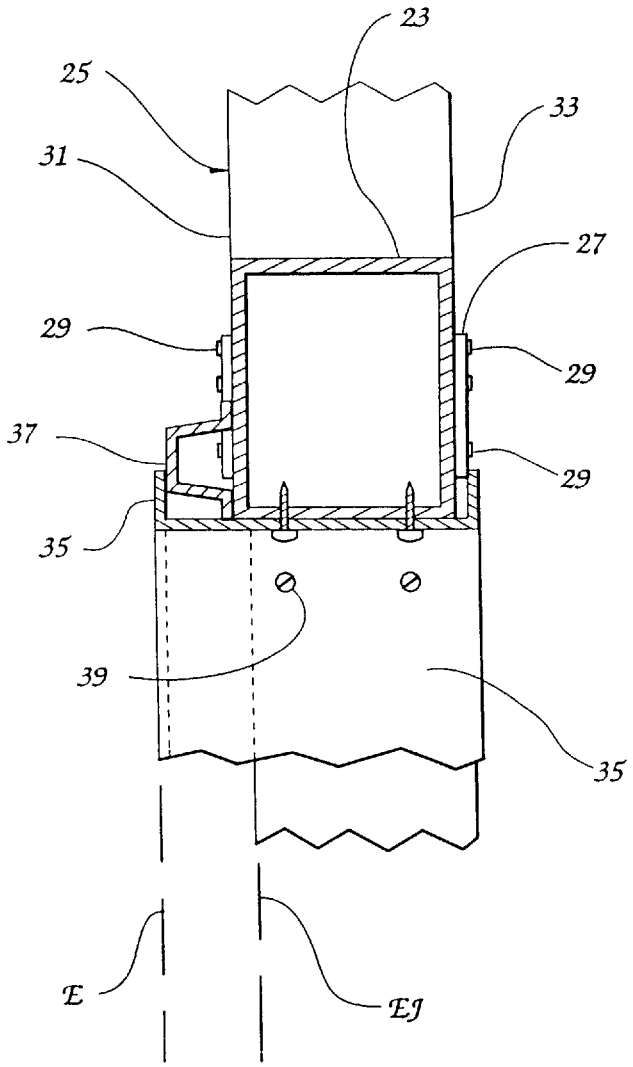
Prior Art Fig. 2
FIG. 2 is a cross-sectional view of the header to jamb connection of FIG. 1, taken along line 2—2 of FIG. 1.

FIG. 2 illustrates the conventional header assembly 21 in a cross-sectional view, and shows the tabs 27 and threaded fasteners 29 connected to and projecting beyond the exterior jamb surface 31 and the interior jamb surface 33. Thus, the tab 27 and the threaded fasteners 29 extend beyond the plane of the exterior jamb surface 31, which is indicated by line EJ.

As is well known, for connection of exterior sheathing or cladding to the conventional header assembly 21 it is necessary to have a series of attachment surfaces which are located in a generally uniform plane, so as to allow the exterior sheathing or cladding to be mounted in a uniform, square, and pleasing orientation. The above-mentioned projection of the tab 27 and the threaded members 29 beyond the plane EJ thus does not permit the attachment of exterior sheathing or cladding directly to the jamb member 25. In order to create the desired set of generally coplane or attachment surfaces, jamb liners 35 and a girt 37 are installed on the conventional header assembly 21 by threaded fasteners 39, or other appropriate arrangement as known in the art. The jamb liners 35 and the girt 37 provide attachment surfaces generally in the plane indicated by line E, which projects beyond a plane EJ and allows mounting of exterior sheathing or cladding thereon as desired. A similar arrangement, although not shown in FIG. 2, may be provided on the interior jamb surface 33 if the interior walls of the building frame are to be finished with wallboard or other materials.

Figure 3:
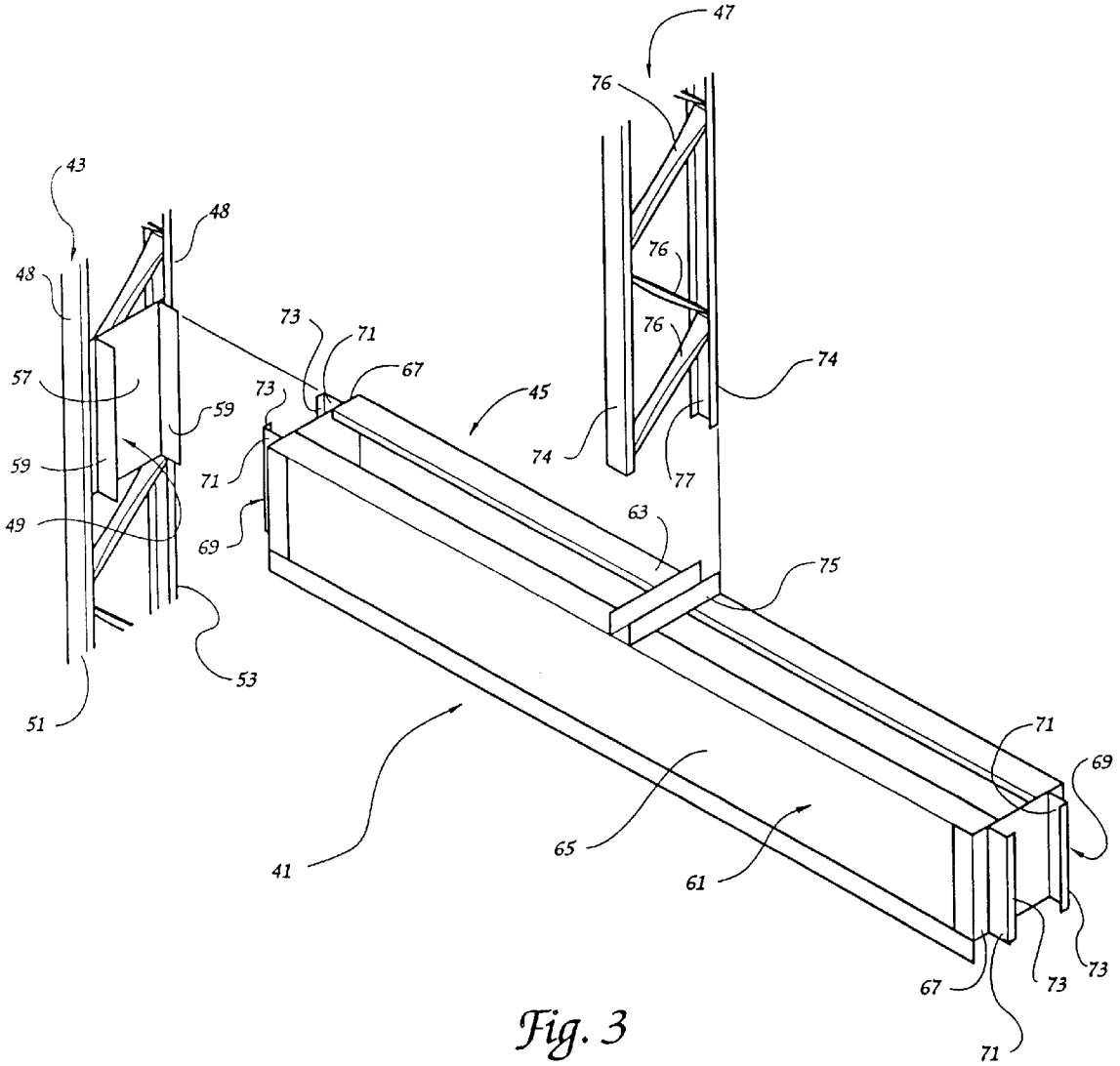
FIG. 3 is a perspective view of the header connection assembly of the present invention.

FIG. 3 illustrates a header connection assembly 41 of the present invention in exploded form, with a truss stud member 43, a header member 45, and a cripple truss stud member 47. The stud member 43 has chord members 48 and a side portion 49 with a vertically extending exterior edge 51 and a vertically extending interior edge 53. A plate 55 (see FIG. 4) is mounted on the side portion 49, and a channel 57, which has two flanges 59, is in turn mounted on the plate 55.

Figure 4:
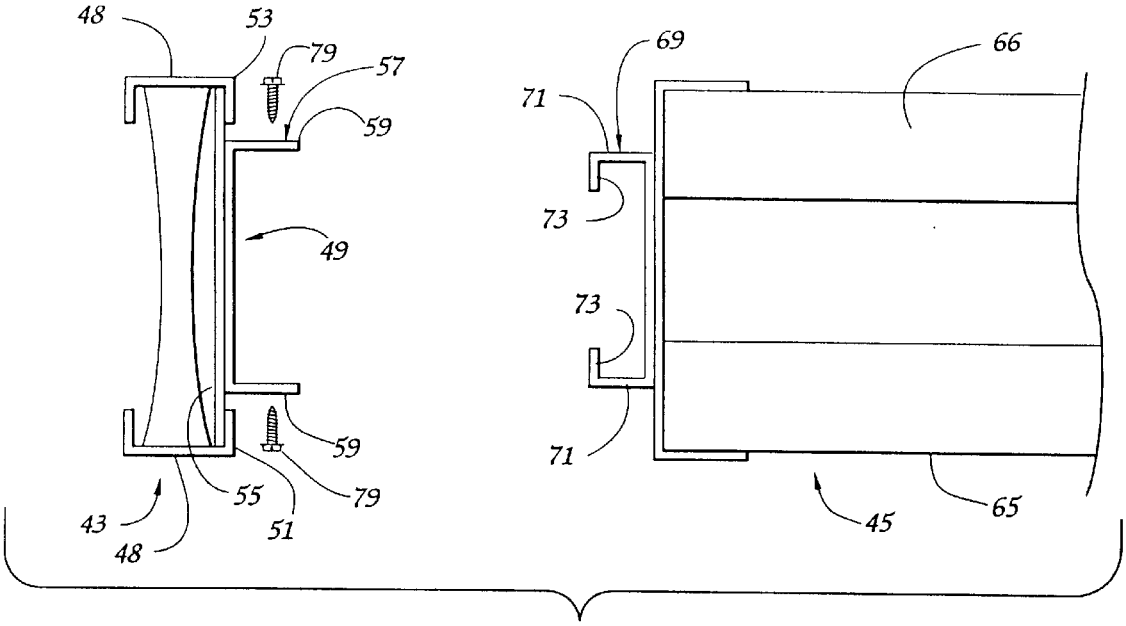
FIG. 4 is a horizontal sectional view of the header connection assembly of FIG. 3.

The header member 45 is of composite construction, and consists of a number of inter-connected channel members which form a body portion 61 having a top surface 63, a generally planar exterior surface 65, and a generally planar interior surface 66 (see FIG. 4). The header member 45 also includes two ends 67, each of which has a cee channel 69 mounted thereon, with the cee channels 69 each including two flanges 71 which have respective inwardly angled distal portions 73.

The cripple stud member 47 is of construction generally similar to the stud member 43, and includes chord members 74 and webbing 76. A cripple stud channel 75 is mounted on the top surface 63 of the header member 45 to receive an end 77 of the cripple stud member 47.

Figure 5:
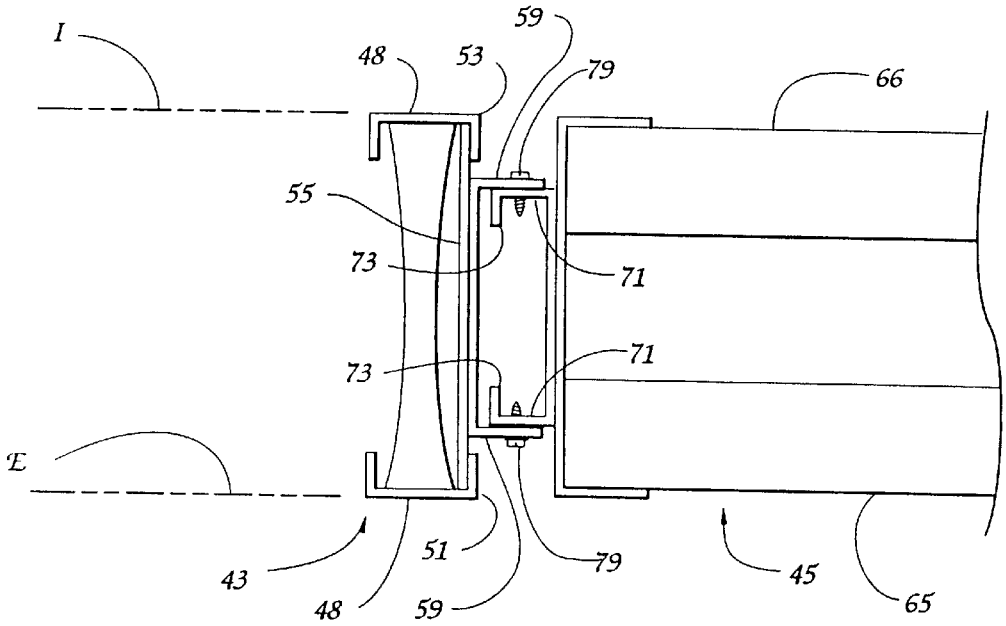
FIG. 5 is an assembled horizontal sectional view of the header connection assembly of FIG. 3.

As shown in FIGS. 4 and 5, the flanges 71 of the header member 45 are configured to be received within the flanges 59 of the stud member 43 in friction fit, and to be fastened thereto by threaded fasteners 79, although other known means of fastening such as welding, rivets or the like, are within the scope of the present invention. The inwardly turned ends 73 of the flanges 71 assist in engaging of the flanges 71 with the stud member flanges 59 in lapping relation, by preventing the stud member flanges 59 from being received inward of the header member flanges 71. It will also be understood that the scope of the present invention includes other arrangements in which some or all of the stud member flanges 59 are received inward of the header member flanges 71.

The present invention's provision for fastening of the stud member flanges 59 to the header member flanges 71 places the points of attachment inward of the stud member side edges 51, 53, as seen in FIG. 5. Thus, the exterior surface 65 of the header member 45 can be generally aligned with the stud member exterior edge 51, and the header member interior surface 66 likewise can be generally aligned with the stud member interior edge 53, all without the need for jamb liners or girts. This advantageous arrangement creates a series of exterior surfaces which are generally within the plane indicated by line E, and a series of interior surfaces which are generally within the plane indicated by line I, thus providing an advantageously configured arrangement for, respectively, attachment of exterior sheathing or cladding, or interior wallboard or other material thereto.

Figure 6:
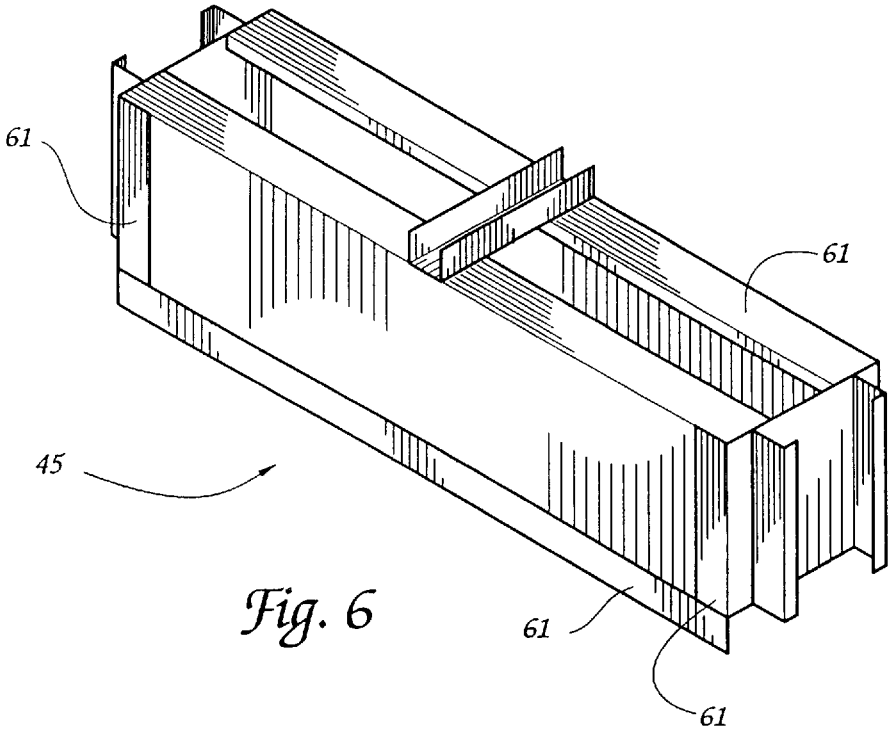
FIG. 6 is a perspective view of the header member of the present invention.

A prefabricated header member 45 is shown in FIG. 6, ready for installation in the structural frame of a building. As described above, the header member 45 is constructed entirely of metal channel members 61, and can be easily prefabricated by welding or other method in a shop, or on site if necessary. The simple construction of the header member 45 lends itself to mass production, and permits finished header members 45 to be shipped to the job site ready for installation.

Figure 7:
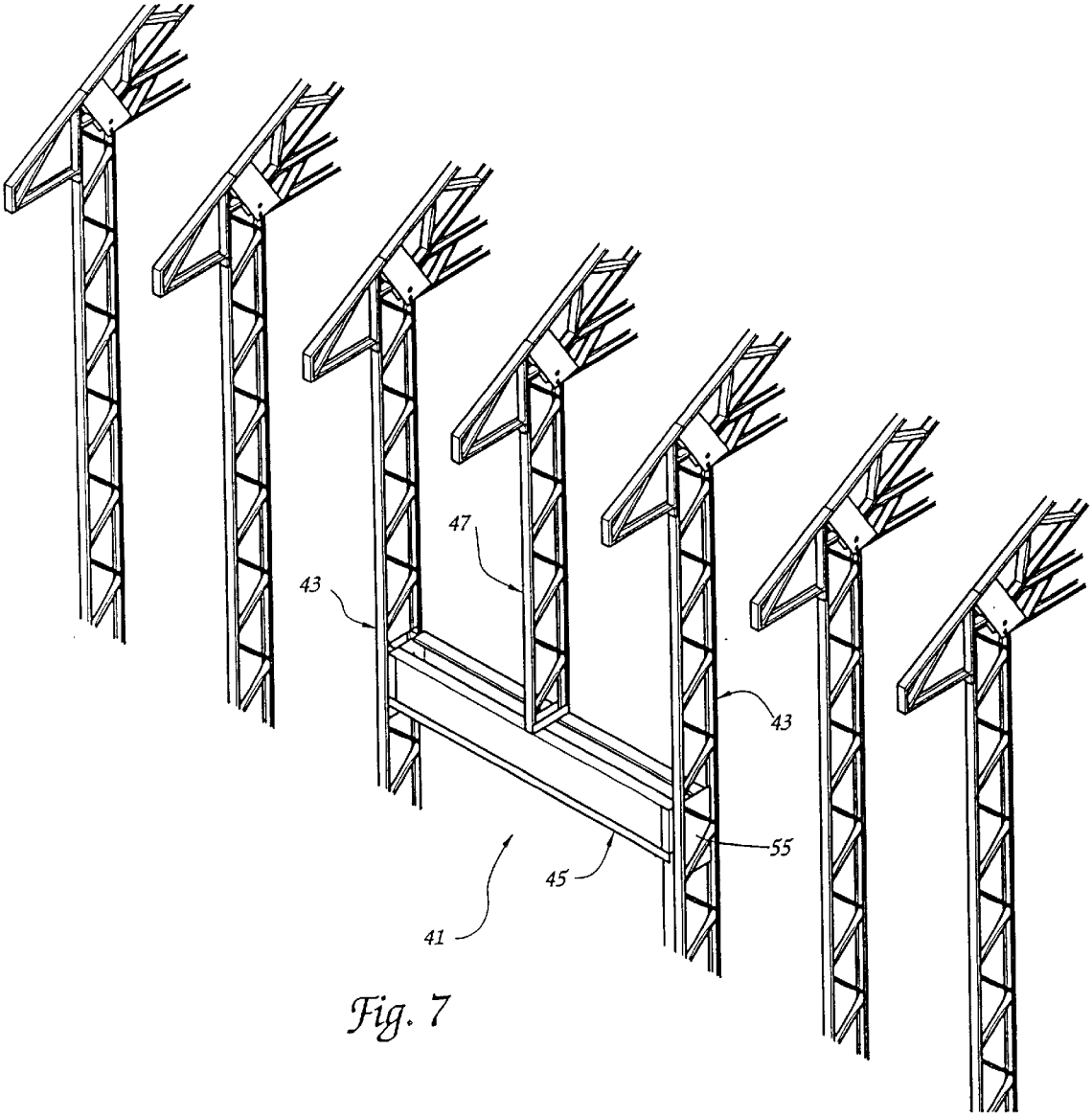
FIG. 7 is a perspective view showing the header connection assembly of the present invention installed in a building structural frame.

In FIG. 7, incorporation of the header connection assembly of the present invention into the structural frame of a building is shown, with the header member 45 mounted between two stud members 43, and the cripple stud member 47 supported there above on the header member 45. The header connection assembly 41 of the present invention provides for a strong structural connection between the header member 45 and stud members 43, while also permitting exterior sheathing or cladding and interior wallboard to be mounted without the use of jamb liners, girts, or other furring arrangements. The details of the building frame shown in FIG. 7 are disclosed in my co-pending Application No. 08/958,097, and do not form part of the present invention.

Installation of the header connection assembly 41 of the present invention is quick, easy, and efficient. As noted above, a prefabricated header member 45 can be provided to a job site where the structural frame of a building is being assembled. The stud members 43 can also be supplied each with a plate 55 and a channel 57 already installed at the appropriate height, by, for example, welding, although other known methods of attachment of the channel 57 and the plate 55 to the stud member 43 are also within the scope of the present invention. It is advantageous if the plate 55 is mounted so that its edges are received within and butted against the channels which form the chord members 48 of the truss stud members 43, as shown in FIGS. 4 and 5.

Once the stud members 43 have been installed at the appropriate locations with the channels 57 in opposed relation and with their respective flanges extended into the opening to be spanned, the header member 45 can be installed by inserting the header member flanges 71 within the stud member flanges 59, as shown in FIG. 5. The threaded fasteners 79 are then engaged through the flanges 71, 59 to secure them to each other and to create a strong and rigid connection.

The cripple stud member 47 is installed in a header member channel 75, and secured therein by threaded fasteners 79 (not shown) or other appropriate fastening method. This simple and quick procedure produces the assembly shown in FIG. 7 consisting of the stud members 43, the header member 45, and the cripple stud member 47, which integrates readily into the building structural frame.

The header connection assembly of the present invention 41 thus has several advantages over previous header connection arrangements. By moving the points of connection between the header member 45 and the stud members 43 inward of the exterior and interior planes of the structural frame, the present invention eliminates the necessity of using jamb liners, girts, and other furring arrangements which were previously required in order to produce generally co-planar surfaces for installation of exterior and interior sheathing, cladding, and/or wallboard thereon. The present invention thus makes it possible to install exterior wall sheathing, such as metal or plywood sheets, directly to the stud members 43 and the header member 45 if desired, producing an economical and sturdy building system. Additionally, interior finishing of the building frame, if desired, is also made easier in the same way, and interior sheathing, paneling, and/or wallboard may be installed directly on the stud members 43 and the header member 45 on their interior surfaces.

The header connection assembly of the present invention also lends itself to significant prefabrication, in that the header member 45 can be completely assembled in a shop or factory, and the channels 57 and the plates 55 on the stud members can likewise be pre-installed away from the construction site. Installation of the header connection assembly 41 can then be quickly accomplished on-site by the use of threaded fasteners, such as screws, which can be efficiently installed through the use of power drivers or other appropriate tools to join the flanges 71, 59. The header connection of the present invention therefore produces a strong and rigid structural joint, can be quickly and efficiently installed, and also speeds up the construction process by eliminating the time-consuming requirement of installing jamb liners, girts, and other furring arrangements.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An assembly forming a header connection, comprising:

a pair of vertically extending stud members each having a predetermined depth and a side including two vertically extending edges, said stud members being oriented in spaced parallel relation with said sides in opposed relation;

each said side including a pair of projecting generally parallel first flanges spaced apart a distance less than said depth of said stud members and positioned offset inwardly from said edges;

a header member having two ends and a body portion extending between said ends, each end having a pair of longitudinally projecting generally parallel spaced second flanges formed to engage said first flanges in lapping relation offset inwardly from said edges;

means for fastening said first flanges to said second flanges, whereby said header member can be mounted between said stud members and said first and second flanges are offset inwardly from said edges.

2. The header connection assembly of claim 1, wherein said header member includes a top surface and a pair of generally parallel spaced flanges projecting upwardly therefrom intermediate said ends, and further including a cripple stud member received in said upwardly projecting flanges and extending upwardly therefrom in spaced parallel relation to said stud members, and means for fastening said cripple stud member to said upwardly projecting flanges.

3. The header connection assembly of claim 1, wherein said edges of each said stud member comprise an exterior edge and an interior edge, said exterior edges being generally aligned with each other, and said header member includes a generally planar exterior surface generally aligned with said exterior edges.

4. The header connection assembly of claim 3, wherein said interior edges are generally aligned with each other and said header member includes a generally planar interior surface generally aligned with said interior edges.

5. The header connection assembly of claim 1, wherein each of said stud members is a truss member including a pair of vertically extending spaced chord members and a web portion extending between said chord members.

6. The header connection assembly of claim 5, wherein said stud members and said header member are formed of metal.

7. The header connection assembly of claim 5, wherein said web portion comprises a plurality of struts.

8. The header connection assembly of claim 5, wherein said chord members are channel members.

9. The header connection assembly of claim 5, wherein each said stud member side portion includes a plate member mounted on said chord members and supporting said first flanges.

10. The header connection assembly of claim 1, wherein said second flanges are received within said first flanges in lapping relation, and each of said second flanges includes a distal portion having an inwardly angled end allowing ease of engagement within said first flanges.

11. The header connection assembly of claim 1, wherein each said stud member side includes a channel member having two flanges forming said first flanges.

12. The header connection assembly of claim 1, wherein each end of said header member includes a header channel member having two flanges forming said second flanges.

13. The header connection assembly of claim 1, wherein said body portion of said header member comprises a plurality of interconnected channel members.

14. The header connection assembly of claim 1, wherein said means for fastening said first flanges to said second flanges comprise a plurality of mechanical fasteners, and said mechanical fasteners are offset inwardly from said stud member edges.

15. An assembly forming a header connection, comprising:

a pair of vertically extending metal stud members each having a predetermined depth and a side including a vertically extending exterior edge and a vertically extending interior edge, said studs being oriented in spaced parallel relation with said sides in opposed relation and said exterior edges generally aligned with each other and said interior edges generally aligned with each other;

each said side including a pair of projecting generally parallel first flanges spaced apart a distance less than said depth of said stud members and positioned offset inwardly from said edges;

a metal header member having two ends, a body portion extending between said ends, a top surface, a generally planar exterior surface, and a generally planar interior surface, each said end having a pair of longitudinally projecting generally parallel spaced second flanges formed to engage said first flanges in lapping relation, said top surface having a pair of generally parallel spaced flanges, said exterior surface being generally aligned with sad exterior edges, and said interior surface being generally aligned with said interior edges;

a metal cripple stud member received in said generally parallel spaced flanges, said cripple stud member extending upwardly therefrom in spaced parallel relation to said stud members; and a plurality of threaded fasteners that fastens said first flanges to said second flanges, whereby said header member is mounted between said stud members, and said first flanges, said second flanges, and said threaded fasteners are offset inwardly from said exterior and interior edges.

* * * * *